US005502941A

United States Patent [19]

Zember et al.

[11] Patent Number: 5,502,941

[45] Date of Patent: Apr. 2, 1996

[54] METHOD AND APPARATUS FOR PRODUCING AN ORNAMENTAL CONCRETE SURFACE

[75] Inventors: Louis F. Zember, Fallbrook; Kenneth W. Masters, Carlsbad; James A. Ogilvie; Edward Shea, both of Vista, all of Calif.

[73] Assignee: Ultra-Tex Surfaces, Inc., Fallbrook, Calif.

[21] Appl. No.: 176,945

[22] Filed: Jan. 3, 1994

[51] Int. Cl.[6] ..... E04F 21/04

[52] U.S. Cl. ..... 52/314; 52/311.1; 52/315; 427/282; 427/403

[58] Field of Search ..... 52/311.1, 311.2, 52/311.3, 314 OR, 315, 316; 427/282, 262, 403

[56] References Cited

U.S. PATENT DOCUMENTS

| | | | |
|---|---|---|---|
| 3,524,790 | 8/1970 | Mason | 52/314 X |
| 3,594,968 | 7/1971 | Johnson | 52/311.1 X |
| 3,660,214 | 5/1972 | Nichols, Jr. et al. | 52/315 X |
| 3,683,579 | 8/1972 | Beardsley . | |
| 3,737,511 | 6/1973 | Dillon . | |
| 4,054,699 | 10/1977 | Brinkley . | |
| 4,164,598 | 8/1979 | Wilhelm | 52/314 X |
| 4,293,599 | 10/1981 | Hori et al. . | |
| 4,349,588 | 9/1982 | Schiffer | 427/403 X |
| 4,510,729 | 4/1985 | Syring | 52/311.1 X |
| 4,644,719 | 2/1987 | Salazar | 52/311.1 X |
| 4,665,673 | 5/1987 | Diana | 52/314 |
| 4,975,303 | 12/1990 | McKinnon . | |
| 5,215,402 | 6/1993 | Stowell et al. . | |
| 5,398,458 | 3/1995 | Henriksen et al. | 52/311.1 X |

FOREIGN PATENT DOCUMENTS

| | | | |
|---|---|---|---|
| 3267452 | 11/1991 | Japan | 52/311.1 |
| 1091791 | 11/1967 | United Kingdom | 52/311.1 |

OTHER PUBLICATIONS

"Popular Mechanics" Jan. 1994 pp. 56–59.
"Classy Concrete" by Roy Berendsohn.

*Primary Examiner*—Wynn E. Wood
*Attorney, Agent, or Firm*—Wagner & Middlebrook

[57] ABSTRACT

An ornamental coating and process for applying the coating to a substrate includes mixing a first batch of liquid mortar composed of sand, cement and an aqueous solution of acrylic resin, and trowelling or spraying a first layer of the liquid mortar onto the substrate and allowing the liquid mortar to cure. A second batch of liquid mortar is mixed which is the same as the first except that it contains a color pigment contrasting with the color of the first batch. A template defining a pattern of grout lines is placed over the cured first batch and the second batch of liquid mortar is trowelled or sprayed over the first batch and the template as a second layer and allowed to cure only to the extent that the second layer is firm, but not hard. The template is then removed, removing that part of the second layer immediately above the template thus exposing lines of the cured first batch which then appear as grout lines between areas of colored mortar which appear as bricks, flagstone or tiles etc. When the second batch has completely cured, two layers of concrete sealer are applied.

8 Claims, 5 Drawing Sheets

FIG. 2
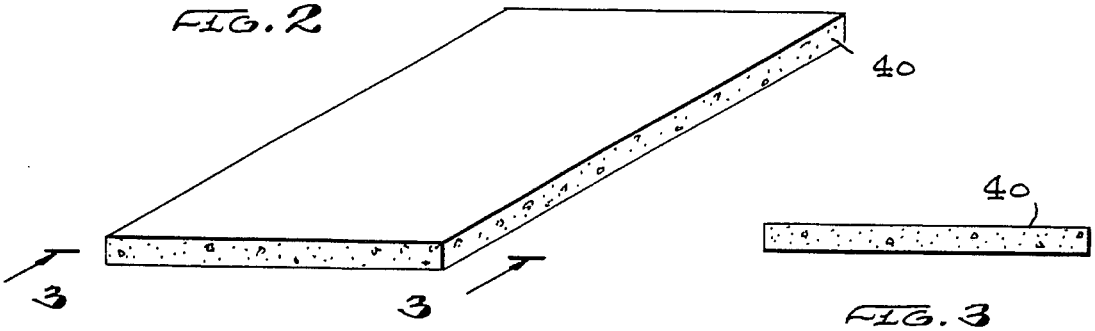
FIG. 3
FIG. 4
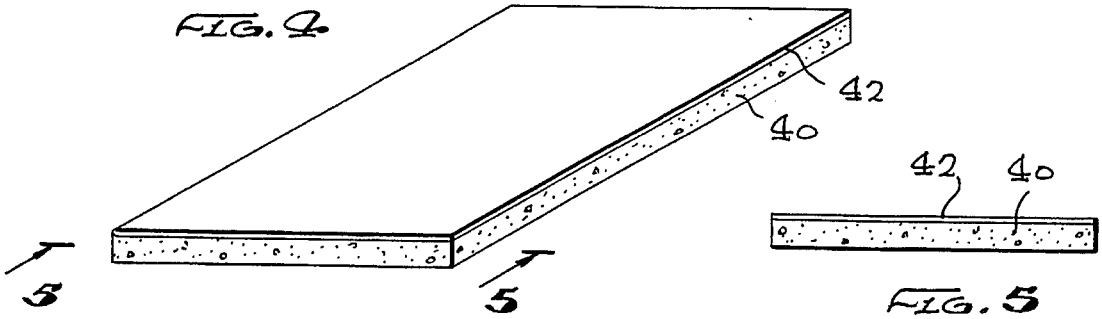
FIG. 5
FIG. 6
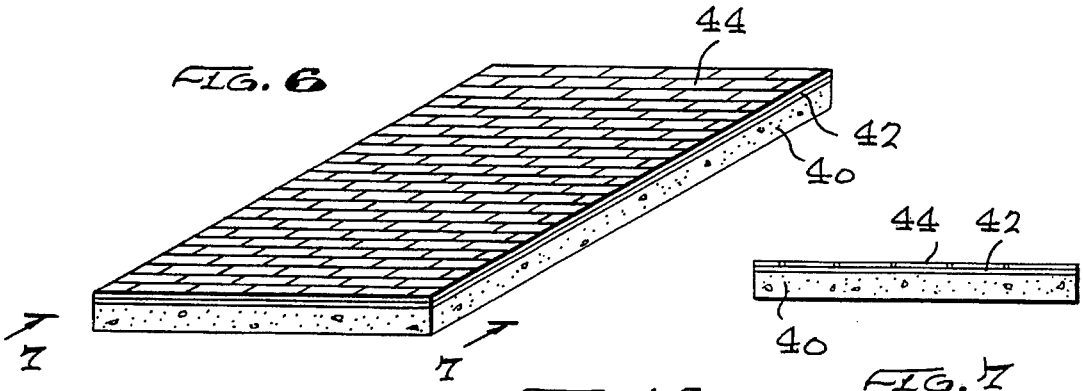
FIG. 7
FIG. 13
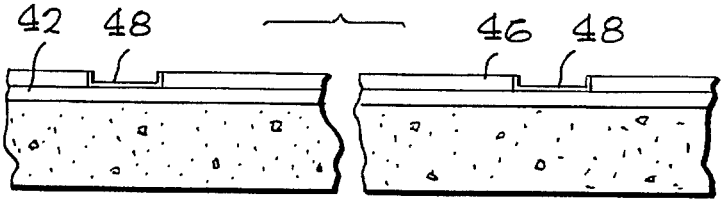

FIG. 8
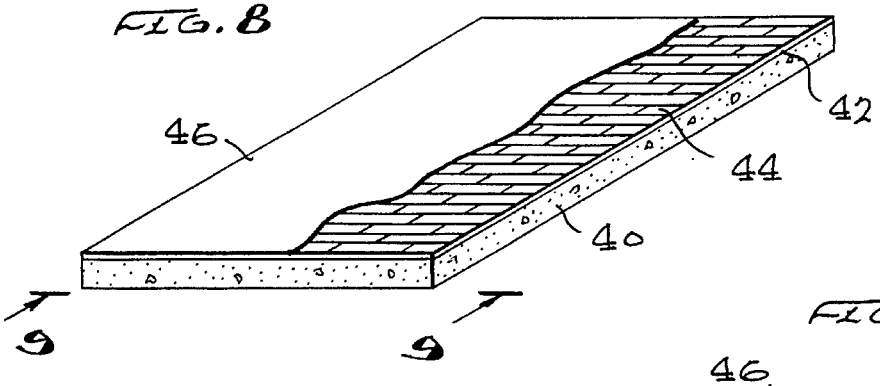
FIG. 9
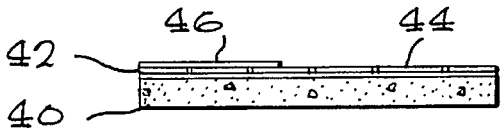
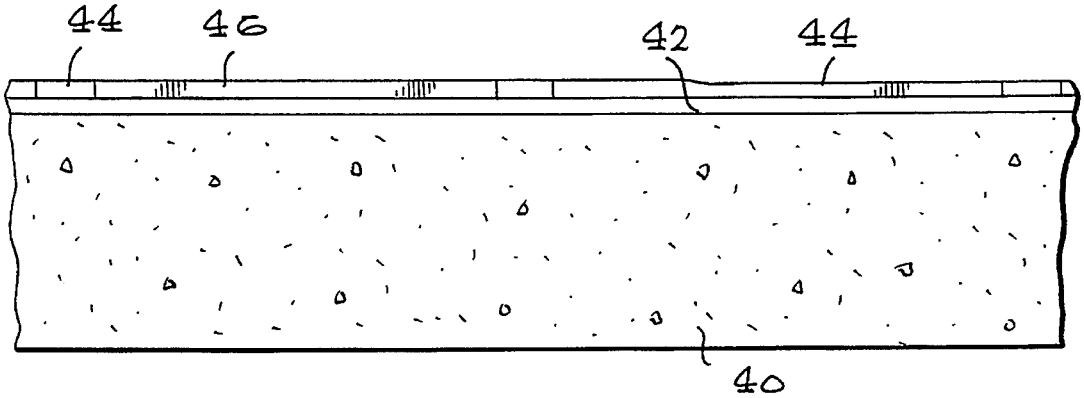
FIG. 10
FIG. 11
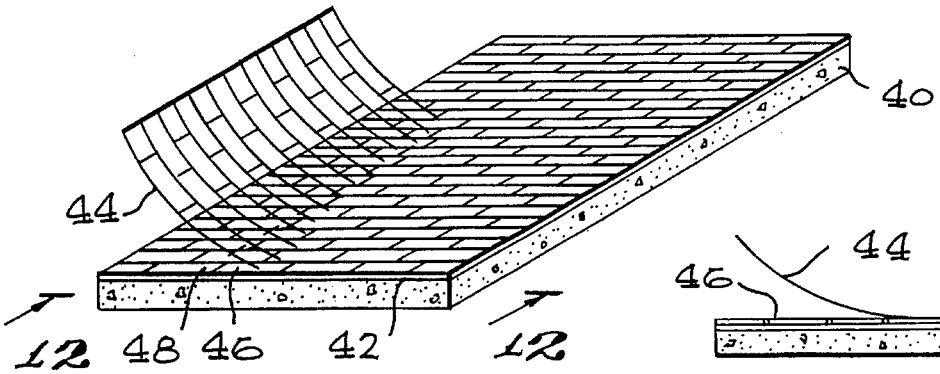
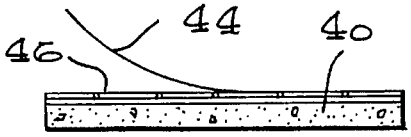
FIG. 12

METHOD AND APPARATUS FOR PRODUCING AN ORNAMENTAL CONCRETE SURFACE

BACKGROUND OF THE INVENTION

This invention relates to a process for producing ornamental concrete surfaces on concrete or other substances.

Various processes for texturing or coloring, or putting patterns on concrete surfaces are known from simple processes such as sweeping partially set concrete to produce a "broom surface" to adding coloring agents to the cement to produce colored concrete. Colored concrete is often patterned by manually imprinting a flagstone pattern, for example, into a concrete surface while it is sill somewhat wet, but firm enough to retain the pattern. More elaborate surface treatments are known including embedding stones varying in size or color into concrete surfaces by means of cement or resin. Frequently patterns are created by dividing the concrete surface into areas and embedding stones, etc. of different colors and sizes into the concrete surface.

Often a concrete base is covered with cement and bricks, half bricks or flagstone are cemented to the base. This is an old and well known technique which currently is considered quite expensive as to both labor and materials required.

U.S. Pat. No. 3,737,511 to T. R. Dillon teaches a method for producing an ornamental concrete surface involving embedding attractive stone-like members on the surface with an adhesive for bonding followed by removal of forms.

Other patents directed to marble chips secured to a floor surface by means at an acrylic resin which surface may be wood or concrete are typified by U.S. Pat. No, 4,975,303 to G. McKinnon or U.S. Pat. No. 4,064,699 to J. Brinkley.

U.S. Pat. No. 3,683,579 to J. Beardsley discloses a method for producing imitation bricks on a surface with a mortar line. the method does, however, require each individual imitation brick to be nailed in place and the nail heads covered with paint.

From the foregoing, it will be apparent that most of the processes discussed above require substantial expenditures of time and materials (hence, money) and/or fail to produce a satisfactory effect from an aesthetic standpoint. There is a need for a technique for producing a decorative surface on a concrete or other base which has an appearance including mortar lines much like that wherein actual bricks or flagstones are inlaid into concrete, but which is less expensive to produce.

SUMMARY OF THE INVENTION

Applicant has provided a process and resulting product which meets the above need in that it requires substantially less in the way of time and materials as compared to embedding actual bricks, tiles, or flagstones, etc. in concrete, but which produces a similar appearance with simulated bricks or flagstones or other patterns and with consistent and identifiable visible grout lines.

The ornamented surface produced by the applicants' process is quite thin, being only from one-sixteenth inch to one-quarter inch thick. This makes it possible, for example, to apply this surface over a patio which is in elevation quite close to the bottom or sill of adjoining doors. If one were to want to surface such a patio with a real brick or flagstone surface, it would be necessary to remove the entire existing concrete patio to make available the required two or three inches of elevation to accommodate the thickness of the bricks or flagstones without raising the surface above the base of the door. Applicants' process produces an ornamental coating almost indistinguishable from real bricks or flagstones, but which could easily be installed over an existing patio without concern for exceeding the elevation of an adjoining door sill.

The ornamental concrete surface of the invention may be applied over a number of substances including adequately supported wood, metal or concrete. Next, a water-proof sub-base is applied. If it is desired to apply the ornamental coating over an existing concrete patio, for example, any existing cracks are patched. This is preferably done by v-grooving the cracks after which the surface is etched by acid washing to promote adhesion of the ornamental surface. The surface is then neutralized with a material such as backing soda and washed. Following the etching and neutralizing steps, the cracks are filled with epoxy resin and an elastomeric sealant is applied, the sealant having sufficient flexibility to avoid cracking with subsequent temperature changes, etc. Fiberglass webbing is then applied over the cracks.

Over the properly prepared surface, a first mortar layer is applied consisting of a mixture of cement, sand and color pigment mixed to a relatively thin consistency with an aqueous solution of adhesive resin. This mixture is either sprayed on or trowelled and colored with a color which is desired for a visible grout pattern. When this mortar layer has substantially cured, a template is laid over this first layer having a pattern of the desired grout lines such as those between bricks or flagstones. This template is typically of heavy kraft paper impregnated with wax. It is coated on one side with an adhesive which adheres sufficiently to hold the template in place during application of an additional mortar layer but which does not create a bond which would prevent the template from being readily removed by pulling the template off the surface of the first mortar layer or which would cause the template to tear during removal.

With the template securely in place, a second mortar layer is applied which is the same as the first mortar layer except that it is mixed with a contrasting color to give the appearance, for example, of brick or flagstones. This layer may be sprayed on or applied with a trowel after which it is permitted to cure or "set". The template is then removed leaving the first mortar layer visible as grout lines between remaining areas of the second layer which then appear as bricks, flagstones, tiles or whatever surface effect is established by the color and the template chosen. Following removal of the template, any chips on an edge of the second layer adjacent the grout lines can readily be repaired or "touched up" with a trowel, if necessary.

Certain artistic effects can be accomplished by applying over the second mortar layer after it cures and before the template is removed, a third mixture of grout of a color contrasting with that of the second layer, as for shading. This coat may be applied by trowelling or by spraying and the effect will depend upon the artistry of the workman.

When the second mortar layer and the third coat, if any, have cured, a clear concrete sealer is applied which is allowed to dry for at least two hours and then a second coat of clear concrete sealer is applied. When this coat has dried, the process is complete.

Where conditions permit, applicants can sometimes spray the mortar layers rather than trowelling; however, it is usually preferable to trowel the mortar. Frequently spraying cannot be used because of wind conditions resulting in overspray on adjacent areas. Once the mortar adheres to a surface, it is extremely difficult to remove.

Applicants have developed a spray gun system which is particularly useful for practicing the above process. The mortar mixture is significantly more liquid (less viscous) than the usual concrete mortar and is effectively sprayed through a spray gun. While it is known to spray concrete mixtures such as for the walls of swimming pools, it is usual to feed a dry Portland cement and sand mix into the spray gun where it is combined with water under pressure and the mixture sprayed out of the spray gun nozzle.

Because of the somewhat more liquid nature of the applicants' mortar mixture, it has been found that by placing the mixture in a pressure vessel where it is maintained under substantial air pressure such as 15 psi gauge, this pressure can force the mortar through a hose to a spray gun which is at the same time connected to the compressed air source. The air pressure in the pressure vessel effectively pumps the liquid mortar through the hose to the spray gun and an additional supply of compressed air is used to atomize the liquid mortar for spraying. A single air compressor is usually adequate to both maintain the pressure in the pressure vessel and to atomize the mixture at the spray gun. Valves in the air line between the air compressor and the spray gun make it possible to control the amount of air being supplied to the spray gun and to the compressor and to disconnect the air compressor from either the pressure tank or the spray gun.

Because of the limited thickness of the mortar layers produced by the above described process, it affords a particular advantage in that, should a given coating prove unsatisfactory for aesthetic or other reasons, it can be easily covered with a new surface providing the same or different patterns and colors. This can be accomplished at similar cost to the first coating except for inherent differences in cost between patterns and differences in preparation cost. In actuality, a second surface placed over a first surface in good condition may actually cost less than the first if the first coating required a substantial preparation.

BRIEF DESCRIPTION OF THE DRAWING

FIG. 2 is a perspective drawing of a concrete substrate ready to receive applicants' ornamental surface;

FIG. 3 is a cross-section of the concrete substrate of FIG. 2;

FIG. 4 is a perspective view of the substrate of FIG. 2 with a first layer of liquid mortar applied;

FIG. 5 is a cross-sectional drawing along lines 5—5 of the substrate of FIG. 4 showing the first layer of mortar applied;

FIG. 6 is a perspective view of the substrate of FIGS. 4 and with a template secured to the surface;

FIG. 7 is a sectional drawing through line 7—7 of FIG. 6;

FIG. 8 is a perspective view of the structure of FIG. 6 with a second layer of mortar applied over a portion of the template;

FIG. 9 is a cross sectional view taken along line 9—9 of FIG. 8;

FIG. 10 a fragmentary view of a portion of FIG. 9 on a larger scale;

FIG. 11 is a perspective view of the substrate of FIGS. 8–10 wherein one template section has been removed and showing another template section in the process of being removed;

FIG. 12 is a cross section along line 12—12 of FIG. 11;

FIG. 13 is an enlarged view of the cross sectional drawing of FIG. 12;

DESCRIPTION OF THE PREFERRED EMBODIMENT

Figure 1:
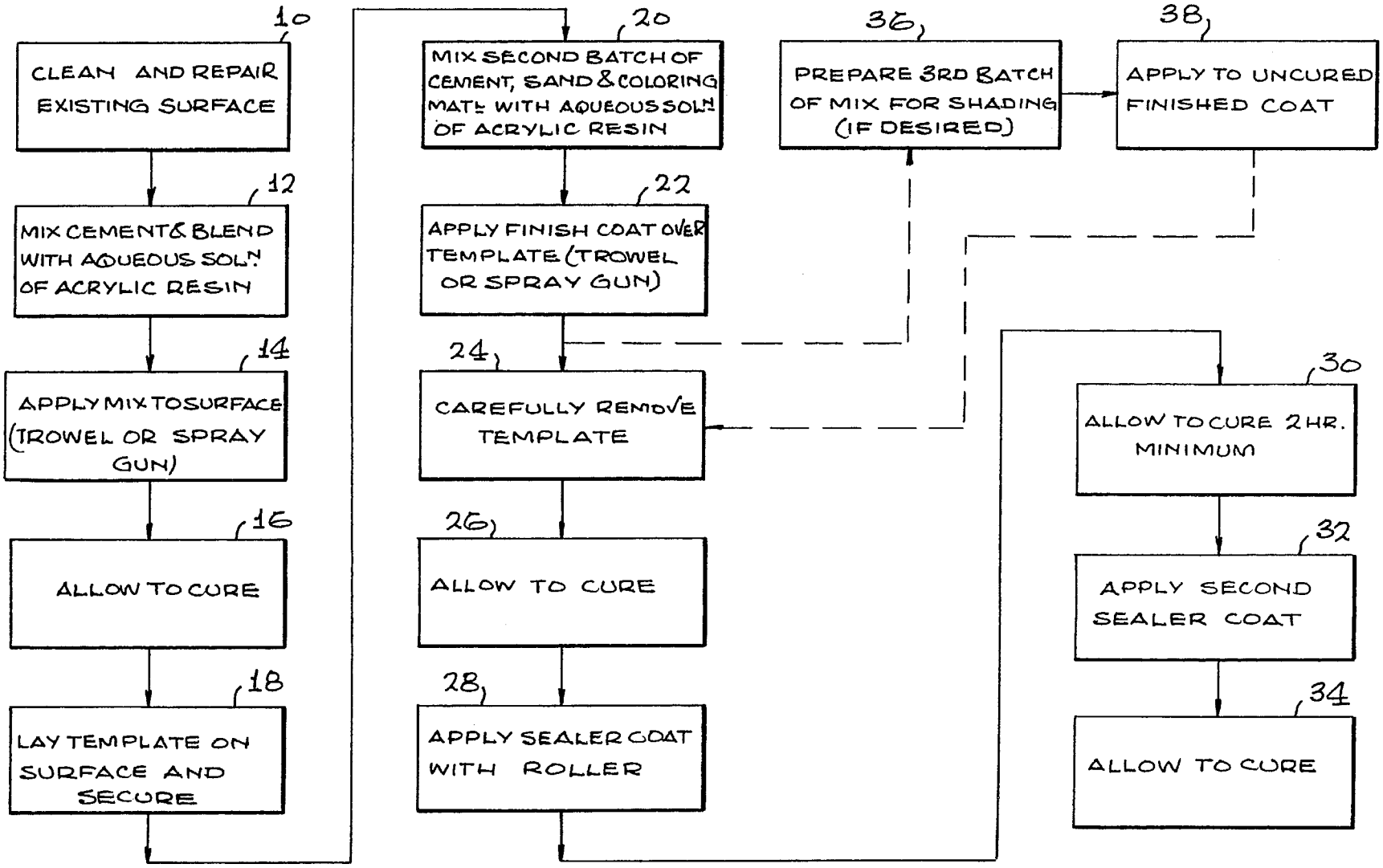
FIG. 1 is a block diagram showing the steps of the applicants' process.
Figure 14:
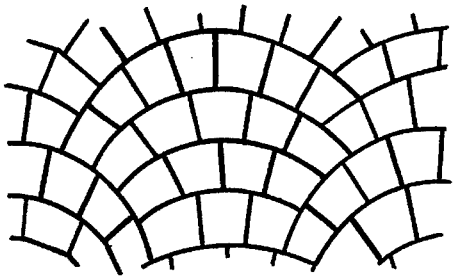
FIGS. 14–19 show typical template patterns which may be used to create various decorative effects on the surface of a substrate.
Figure 19:
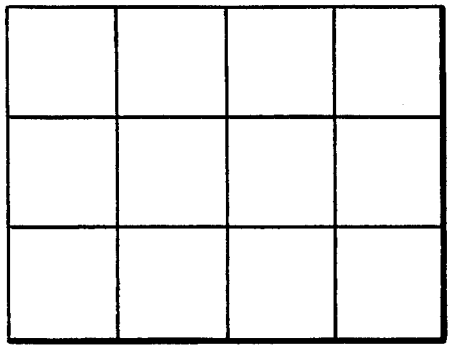
Figure 15:
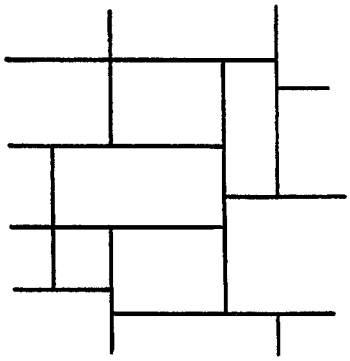
Figure 16:
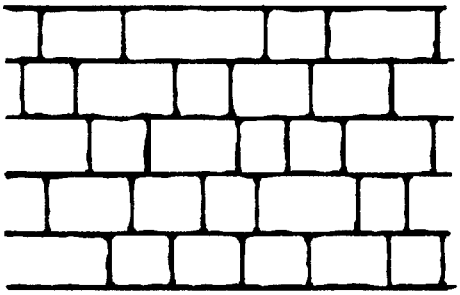
Figure 18:
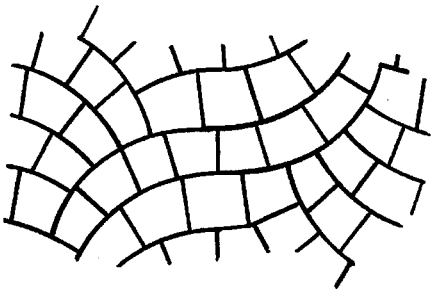
Figure 17:
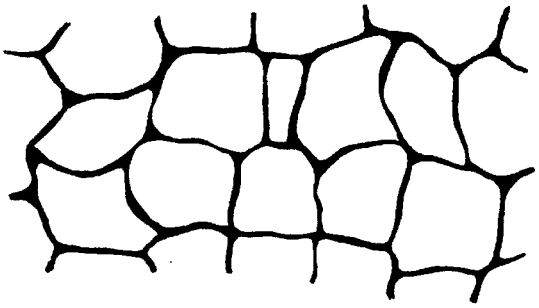

FIG. 1 is a block diagram showing, in order, the steps of applying applicants' ornamental surface to a substrate. While, as indicated above, the usual application for applicants' process would be to apply the ornamental surface to a concrete substrate such as a patio surface, it is also quite possible to apply it to a metal surface or a well supported wood surface if sealed with a proper water proof sealant.

Block 10 defines a process of repairing and cleaning the surface including patching any cracks as set forth above and also acid washing to etch the surface to aid in causing the ornamental surface to adhere properly. Following this or perhaps simultaneous with the cleaning process it is necessary to prepare a mixture of cement and sand and a suitable coloring agent, if desired, to provide a color as desired for the grout lines, which mixture is mixed with an aqueous solution of adhesive resin to provide a mixture having the consistency roughly that of a milkshake. The ratio of cement and sand is approximately 50–50%. The resin solution varies from 1½ to 2 gallons per 46 lb. bag of dry cement/sand mix. It will be recognized that this mixture is substantially thinner and less viscous than the usual concrete mortar mix. This step is outlined in the block 12. Block 14 defines the step of applying the mix to the surface of the substrate which would preferably be done with a trowel but may also be done with a spray gun. Following the application of this mixture to the surface, the mortar is allowed to cure as shown in block 16 following which the chosen template is placed on the surface and secured thereto. This template is normally of heavy kraft paper wax impregnated on both sides and coated on one side with an adhesive which is chosen because it will create a bond which is sufficient to secure the template in place during a subsequent application of mortar, but which does not create a bond so strong as to inhibit the removing of the template when it is desired to do so. Subsequently or simultaneously with applying of the template a second batch of mortar is mixed as indicated in block 20 including again the mixture of cement, sand, coloring and the aqueous solution of acrylic resin. The second batch is then applied over the substrate and over the template as indicated in block 22 by means of a trowel or spray gun and this coat is allowed to dry. After this, as shown in block 24, the template is carefully removed which removes that portion of the second batch immediately above the template and exposes the first coat of a contrasting color which defines the grout lines.

Occasionally when the template is removed there will be small chips which may also be removed from the area of the second coat which indicates the brick, tile or flagstone surface. These chips are easily repaired by means of a trowel. When the template is removed and any patching has been effected, the surface is allowed to cure as indicated by block 26 and a sealer coat is then applied, typically by means of a roller. As indicated by block 28 the sealer coat consists of a layer of acrylic resin which is then allowed to cure for a minimum of two hours as indicated in block 30 after which a second identical sealer coat is applied as indicated in block 32. This coating is also allowed to cure at which point the process has been completed (Block 34).

In some instances, it may be desired to prepare a third batch of mortar mixed in exactly the same way as the second batch, but with a third color for shading or for other decorative affects if desired. This is indicated in block 36 which is shown as an alternate step following the application of the second batch. This third batch of mix is applied to the uncured finish coat prior to the removal of the template as shown in block 38 after which the template is removed and the surface is allowed to cure. This is indicated by the dotted line extending from block 38 to block 24.

The various steps of the above process are illustrated in FIGS. 2–13 where FIG. 2 indicates a typical concrete substrate 40 which may be a patio surface and which has been cleaned, repaired and etched such that it is ready for finishing. FIG. 3 indicates a cross section of this concrete substrate. In FIG. 4, the concrete substrate 40 has been coated with the first batch of mortar 42 which is shown as a separate layer on the surface of the concrete 40.

FIG. 5 is cross-section taken along line 5—5 of FIG. 4 and shows the cross section of the concrete substrate 40 with the first mortar layer 42 applied to its surface.

FIG. 6 is a perspective view of the concrete substrate 40 having the first concrete mortar layer 42 and the template 44 installed on the surface of mortar layer 42. In this particular case, the template is shown as having a brick pattern; obviously, any of several of the other patterns such as those shown in FIGS. 14–18 may be used. This template 44, as indicated above, is preferably of heavy kraft paper wax impregnated on both sides and having an adhesive layer which attaches it to the surface of layer 42 firmly but not so firmly that it cannot be so easily pulled up and removed. Applicant has found a suitable adhesive for the template to be a product of 3M Company sold under the mark "MAC-BOND" and given a number 1B1190. This adhesive is normally attached to the substrate by means of a peal-off backing which is removed prior to installing of the template.

FIG. 7 is a cross section taken along line 7—7 of FIG. 6 and shows the concrete substrate 40, the initial mortar layer 42 and template 44.

FIG. 8 shows a perspective view of substrate 40 with the first layer 42, the template 44 and the second mortar layer 46 partially installed over the template 44.

FIG. 9 is a cross sectional view taken along section 9—9 of FIG. 8 and showing the substrate 40, the initial mortar layer 42, the edges of template 44 and also the layer 46 which is shown partially covering the template 44.

FIG. 10 is an enlarged view of a portion of FIG. 9 showing the respective layers of mortar and the template 44 as described. 25 FIG. 11 is a perspective view of the concrete substrate 40 with layer 42, template 44 and second layer 46 shown and with template 44 shown in the process of being removed from the surface thus carrying off that portion of layer 46 which is immediately above the template exposing the grout lines 48 which are part of the first mortar layer 42.

FIG. 12 is a cross sectional view taken along line 12—12 of FIG. 11 indicating in particular the separate areas of mortar layer 46 which remain after the removal of template 44.

FIG. 13 is an enlarged view of a portion of FIG. 12 in which the template 44 has been removed leaving the separate areas 46 of the second mortar layer separated from each other with the grout lines 48 from the layer 42 visible between the areas.

In addition to the brick pattern shown in FIGS. 6, 9 and 12 many other patterns of template may be used, some of which may include tile and flagstone patterns shown in FIGS. 14–19.

Figure 20:
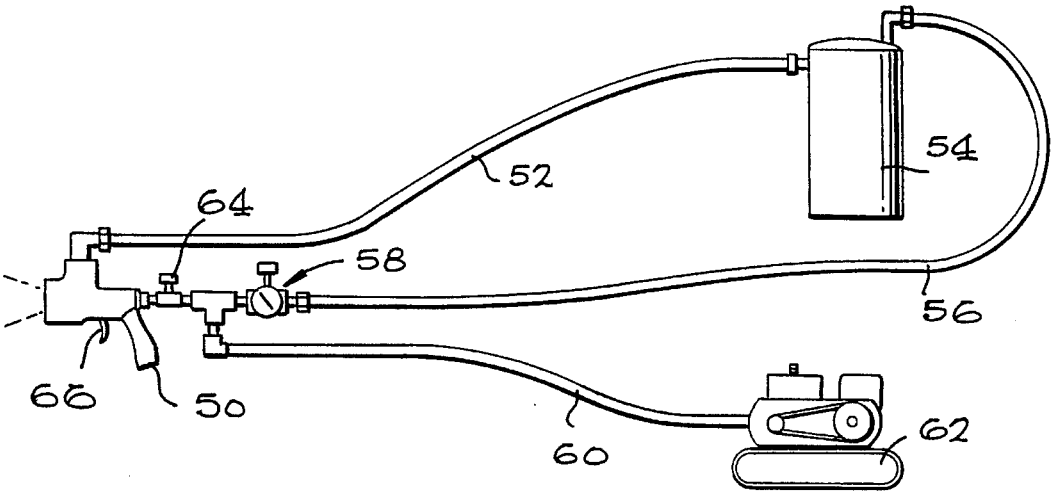
FIG. 20 is a schematic diagram showing the apparatus for spraying the mortar mix used in applicants' process.

In connection with the above described process applicant has devised a particular system for spraying the mortar layers onto the substrate. As shown in FIG. 20 the mortar is sprayed from a spray gun 50 connected to a hose 52 which, in turn is connected to a pressure tank 54.

Pressure tank 54 is connected through a hose 56 to a valve and gauge assembly 58 supplied with air under pressure through a hose 60 connected to an air compressor 62. The valve and gauge assembly 58 includes a manually operated valve 64 which controls the flow of high pressure air to the spray gun 50. Valve and gauge assembly 58 also include a manually operated valve 72 with gauge 74 which controls the flow of air to pressure tank 54. When valve 72 is open, high pressure air from compressor 62 is supplied through hoses 60 and 56 to pressure tank 54 thereby placing the mortar mixture in tank 54 under substantial air pressure. High air pressure in pressure tank 54 will tend to force the mortar mixture through hose 52 to the spray gun 50 but it will not be sprayed from gun 50 unless the valve 64 is open and an operator operates a trigger 66 on the spray gun.

Figure 21:
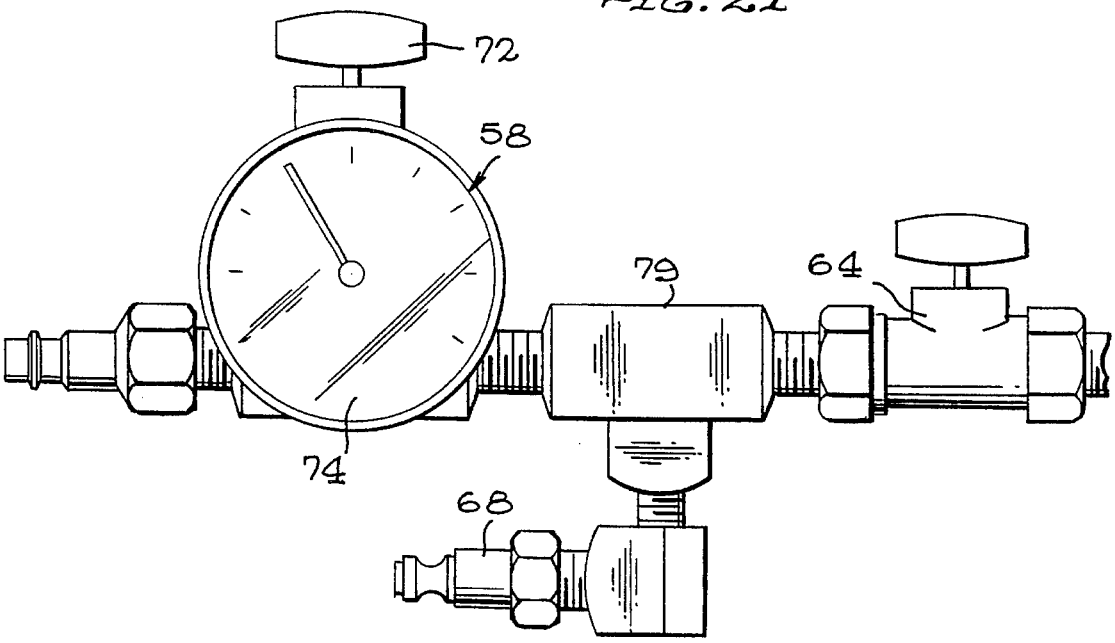
FIG. 21 a side elevational view of a valve structure utilized in the apparatus on FIG. 20.

The construction of the valve and gauge unit 58 is shown in somewhat greater detail in FIG. 21 where air from the compressor 62 is supplied to an air fitting 68 and is supplied to a T-fitting 79, one branch of which goes through control valve 64 to the spray gun, the other branch going to a second air control valve 72 controlling air to pressure tank 54.

The pressure of compressed air to tank 54 is sensed by means of gauge 74 which, neglecting losses in hose 56 and fittings, effectively measures and indicates air pressure in tank 54.

The above described embodiments of the present invention are merely descriptive of its principles and are not to be considered limiting. The scope of the present invention instead shall be determined from the scope of the following claims including their equivalents.

What is claimed is:

1. A process of covering a substrate with a decorative surface comprising:

mixing a first batch of cement, sand and an aqueous solution of adhesive resin to create a liquid mortar;

applying the mortar on the substrate to form a first layer on the substrate;

allowing the mortar to cure on the substrate;

providing a lightweight flexible template panel having a pattern of desired grout lines, an adhesive layer and a backing over said adhesive layer;

peeling said backing layer away from said template panel and securing the template to said first layer;

mixing a second batch of cement, sand, color pigment, and an aqueous solution of adhesive resin to create a second batch of liquid mortar contrasting in color with said first batch;

applying said second batch over said first batch and said template to form a second layer and allowing said second layer to fully dry;

removing said template to expose said first layer under said template;

allowing said second batch to finish curing; and applying a sealer coat covering said first and second layers.

2. The process of claim 1 wherein said first batch also includes color pigment.

3. The process of claim 1 wherein a second sealer coat is applied over said first sealer coat.

4. The process of claim 1 wherein a third batch of liquid mortar is prepared including color pigment contrasting with the color of said second batch and said third batch is selectively applied over said second layer before said second batch has finished curing and before said template is removed.

5. A process for coating a substrate with a decorative surface comprising mixing a first batch of liquid mortar consisting of a mixture of cement, sand and an aqueous solution of adhesive resin and applying a first layer of said liquid mortar to said surface;

allowing said first layer to cure;

providing a flexible template panel having a pattern of desired grout lines, an adhesive layer and a backing layer;

removing said backing layer to expose said adhesive layer;

securing said template to said first layer;

mixing a second batch of cement, sand and an aqueous solution of adhesive resin including also a color pigment contrasting with the color of said first batch;

applying a second layer of said second batch of liquid mortar over said first layer and said template and allowing said second layer to fully dry;

removing said template with any part of said second layer immediately above said template, and allowing said second layer to finish curing, and applying a coat of concrete sealer material over said first and second mortar layers.

6. A process as claimed in claim 5 wherein said flexible template is of heavy wax impregnated paper with adhesive backing.

7. The process of claim 5 wherein said first batch also includes color pigment.

8. The process of claim 5 wherein a third batch of liquid mortar is prepared including color pigment contrasting with the color of said second batch and said third batch is selectively applied over said second layer before said second batch has finished curing and before said template is removed.

* * * * *

Disclaimer 5,502,941—Louis F. Zember, Fallbrook; Kenneth W. Masters, Carlsbad; James A. Ogilvie; Edward Shea, both of Vista, all of Calif. METHOD AND APPARATUS FOR PRODUCING AN ORNAMENTAL CONCRETE SURFACE. Patent dated April 2, 1996. Disclaimer filed June 26, 1998, by the assignee Ultra-Tex Surfaces, Inc.

Hereby enters this disclaimer to claims 1, 2 , 3, 4, 5, 7 and 8 of said patent.

*(Official Gazette,* October 20, 1998)